US006179750B1

(12) United States Patent
Lonergan

(10) Patent No.: US 6,179,750 B1
(45) Date of Patent: Jan. 30, 2001

(54) HAND EXERCISE SYSTEM

(76) Inventor: Brian T. Lonergan, 2216 Salem Blvd., Zion, IL (US) 60099-2257

( * ) Notice: Under 35 U.S.C. 154(b), the term of this patent shall be extended for 0 days.

(21) Appl. No.: 09/533,331

(22) Filed: Mar. 23, 2000

(51) Int. Cl.[7] ..... A63B 23/16
(52) U.S. Cl. ..... 482/47; 482/44; 601/40
(58) Field of Search ..... 482/44, 47, 48; 602/21; 128/26; 73/379.01, 379.02, 379.03; 84/467; 601/40

(56) References Cited

U.S. PATENT DOCUMENTS

| | | | | |
|---|---|---|---|---|
| 130,457 | * | 8/1872 | Wenzel | 602/21 |
| 1,301,560 | * | 4/1919 | Hill | 482/44 |
| 2,476,518 | * | 7/1949 | Underwood | 482/44 |
| 5,451,191 | * | 9/1995 | Beenken | 482/47 |
| 5,538,488 | * | 7/1996 | Villepigue | 482/44 |

* cited by examiner

*Primary Examiner*—Stephen R. Crow

(57) ABSTRACT

An exercise system includes an upper planar plate, a lower plate, a sidewall coupling the upper and lower plates to retain them in a spaced parallel relationship forming a housing with a chamber there within. Five slots formed in the upper plate extend from adjacent the lower edge to adjacent the upper edge. A slide member is slidably received within each slot. Each slide member is fabricated of an electrically conductive material with an electrically insulated component secured there above for receiving a finger of a user. Primary electrical contacts located on the upper surface and spaced along the length of the slots on opposite sides thereof are adapted to be contacted by the slide member periodically as the slide member moves along the slot. A plurality of apertures shaped as numbers are formed in the upper plate laterally spaced from the primary electrical contacts. A light bulb is located beneath each aperture. A battery and electrical connectors couple each light bulb to the primary electrical contacts for the illumination thereof when the slide member contacts the various associated electrical contacts.

5 Claims, 4 Drawing Sheets

FIG 3
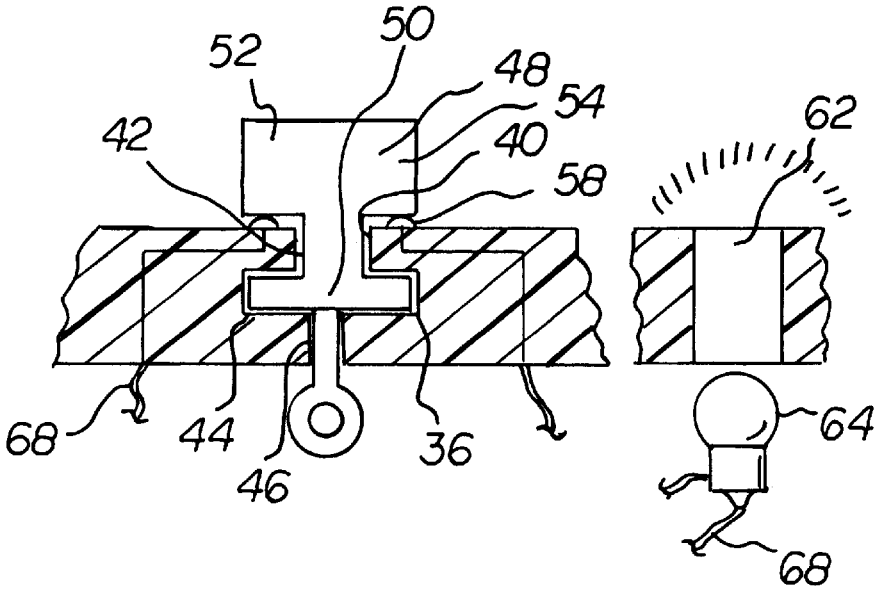
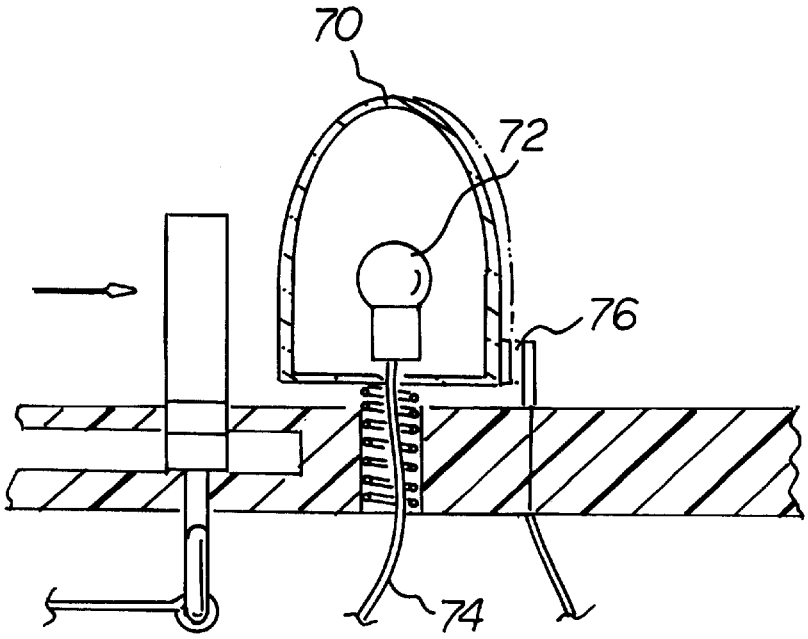
FIG 4

FIG 5
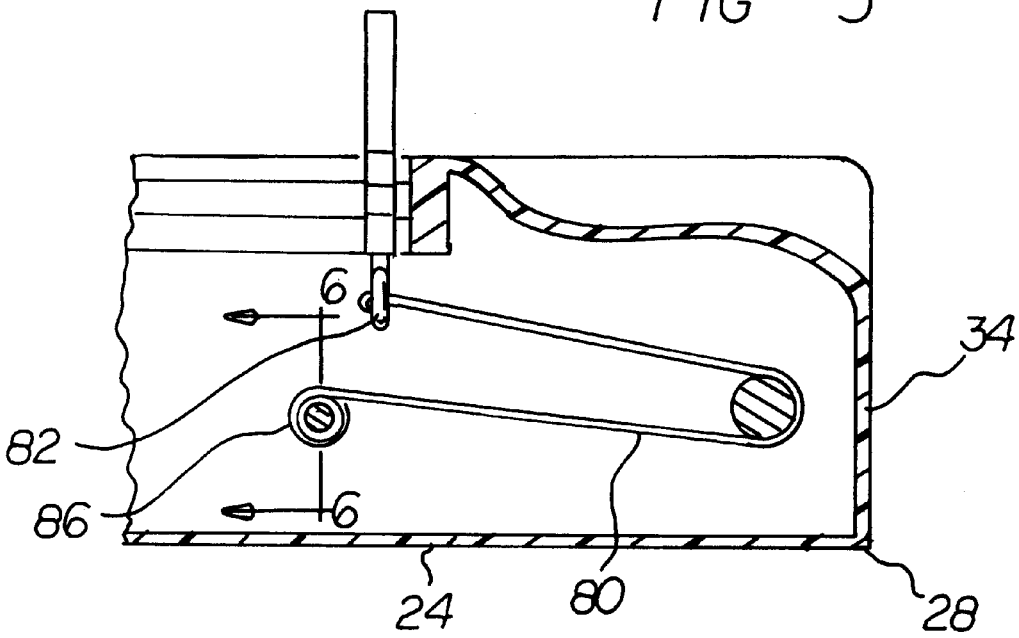
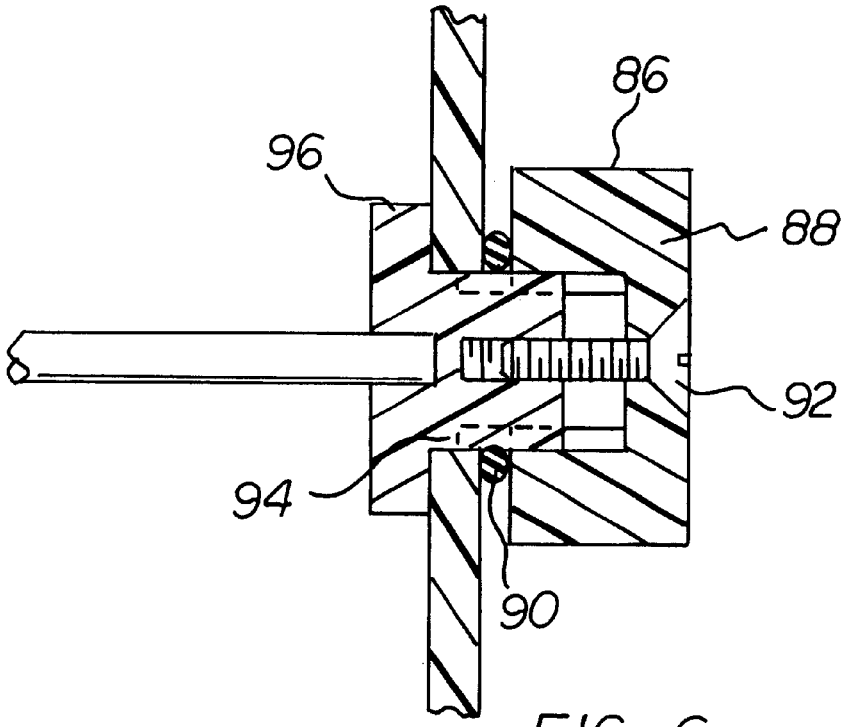
FIG 6

HAND EXERCISE SYSTEM

BACKGROUND OF THE INVENTION

1. Field of the Invention

The present invention relates to a hand exercise system and more particularly pertains to strengthening and testing the individual fingers of the hands of users.

2. Description of the Prior Art

The use of exercise devices of known designs and configurations is known in the prior art. More specifically, exercise devices of known designs and configurations previously devised and utilized for the purpose of strengthening or testing the fingers of users through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 130,457 to F. Wenzel discloses an improvement in finger exercisers. U.S. Pat. No. 3,782,719 to Kuhlman discloses a finger exercising device. U.S. Pat. No. 4,875,469 to Brook et al. discloses a continuous passive motion devices and methods. U.S. Pat. No. 5,113,849 to Kuiken et al. discloses a finger extender. U.S. Pat. No. 5,451,191 to Beenken discloses a finger rehabilitation/exercise device. U.S. Pat. No. 5,514,052 to Charles et al. discloses a finger exerciser. Lastly, U.S. Pat. No. 5,538,488 to Villepigue discloses an exercising glove.

While these devices fulfill their respective, particular objectives and requirements, the aforementioned patents do not describe a hand exercise system that allows strengthening and testing the individual fingers of the hands of users.

In this respect, the hand exercise system according to the present invention substantially departs from the conventional concepts and designs of the prior art, and in doing so provides an apparatus primarily developed for the purpose of strengthening and testing the individual fingers of the hands of users.

Therefore, it can be appreciated that there exists a continuing need for a new and improved hand exercise system which can be used for strengthening and testing the individual fingers of the hands of users. In this regard, the present invention substantially fulfills this need.

SUMMARY OF THE INVENTION

In view of the foregoing disadvantages inherent in the known types of exercise devices of known designs and configurations now present in the prior art, the present invention provides an improved hand exercise system. As such, the general purpose of the present invention, which will be described subsequently in greater detail, is to provide a new and improved hand exercise system and method which has all the advantages of the prior art and none of the disadvantages.

To attain this, the present invention essentially comprises a hand exercise system. First provided is an upper planar plate. The upper planar plate has a planar upper surface with an upper edge and a parallel lower edge. The upper planar plate also has parallel side edges there between. A lower plate is next provided. The lower plate has a planar lower surface with an upper edge and a parallel lower edge. Parallel side edges are provided between the upper edge and parallel lower edge. Next provided is a sidewall. The sidewall couples the upper and lower plates to thereby retain them in a spaced parallel relationship. It also forms a housing with a chamber there within. Five slots are formed in the upper plate extending from adjacent the lower edge to adjacent the upper edge. The slots are spaced closer together at the upper edge than at the lower edge. The slots are even more widely spaced at an intermediate extent proximate to the lower edge. Each slot has an upper slot portion. The upper slot portion extends downwardly from the upper surface of the upper plate to an intermediate extent of the slot. An enlarged track is formed within the upper plate. A lower slot portion is formed beneath the upper plate. A slide member is slidably received within each slot. Each slide member is fabricated of an electrically conductive material. Each slide member has an intermediate enlarged section within the track of the slot. Each slide member also has a downwardly extending connector. Each slide member also has an upwardly extending electrically conductive T-shaped member. An electrically insulated component is secured above the T-shaped member for receiving a finger of a user. Primary electrical contacts are located on the upper surface, along the length of and on opposite sides of the slots. The primary electrical contacts are adapted to be contacted by the slide member periodically as the slide member moves along the slot to thereby close a circuit. A plurality of apertures are provided. The apertures are shaped as numbers. The apertures are formed in the upper plate laterally spaced from the primary electrical contacts. A light bulb is provided beneath each aperture. A battery and electrical connectors are provided. The battery and electrical connectors couple each light bulb to the primary electrical contacts for the illumination of the light bulb when the slide member contacts the various associated electrical contacts. A transparent dome is formed on the upper surface adjacent the upper edge of the upper planar plate. An illuminator is provided within the transparent dome. Electrical connectors extend downwardly from the transparent dome are adapted to illuminate the illuminator when any slide member contacts the uppermost electrical contacts proximate to the upper edge. A rotatable cylindrical post is provided within the housing and journaled in the sidewall adjacent to the lower edge. Such post, when rotated by a user, may increase or decrease the tension needed to push the slide members. A plurality of resilient elastic bands are next provided. Each band has a first end coupled to a corresponding connector of a slide member. Each band has a second end coupled to the post for lengthening or shortening the normal distance between the posts and each slide member. An associated tightening component extends through a sidewall for rotation by a user to effectively lengthen or shorten the effective length of the elastic bands. The tightening component includes a knob with an elastomeric washer between the knob and the sidewall. The tightening component also includes a screw coupling the knob and the cylindrical post. The tightening component further includes coupling axial slots and associated axial projections between the knob and cylindrical member to allow mutual rotation the slots and projections are coupled. This is for locking and unlocking purposes to thereby vary the force needed to effect the movement of the slide members within the slots. FIG. 6 shows a locked orientation. Loosening the screw would relieve the tension in the washer whereby the knob and post couple rotated to a desired tension. Thereafter the screw would be tightened to compress the washer and lock the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand exercise system which has all of the advantages of the prior art exercise devices of known designs and configurations and none of the disadvantages.

It is another object of the present invention to provide a new and improved hand exercise system which may be easily and efficiently manufactured and marketed.

It is further object of the present invention to provide a new and improved hand exercise system which is of durable and reliable constructions.

An even further object of the present invention is to provide a new and improved hand exercise system which is susceptible of a low cost of manufacture with regard to both materials and labor, and which accordingly is then susceptible of low prices of sale to the consuming public, thereby making such hand exercise system economically available to the buying public.

Even still another object of the present invention is to provide a hand exercise system for strengthening and testing the individual fingers of the hands of users.

Lastly, it is an object of the present invention to provide a new and improved exercise system includes an upper planar plate, a lower plate, a sidewall coupling the upper and lower plates to retain them in a spaced parallel relationship forming a housing with a chamber there within. Five slots formed in the upper plate extend from adjacent the lower edge to adjacent the upper edge. A slide member is slidably received within each slot. Each slide member is fabricated of an electrically conductive material with an electrically insulated component secured there above for receiving a finger of a user. Primary electrical contacts located on the upper surface and spaced along the length of the slots on opposite sides thereof are adapted to be contacted by the slide member periodically as the slide member moves along the slot. A plurality of apertures shaped as numbers are formed in the upper plate laterally spaced from the primary electrical contacts. A light bulb is located beneath each aperture. A battery and electrical connectors couple each light bulb to the primary electrical contacts for the illumination thereof when the slide member contacts the various associated electrical contacts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIG. 4 is a cross sectional view taken along line 4—4 of FIG. 1.

FIG. 5 is a cross sectional view taken along line 5—5 of FIG. 1.

FIG. 6 is a cross sectional view taken along line 6—6 of FIG. 5.

The same reference numerals refer to the same parts throughout the various Figures.

DESCRIPTION OF THE PREFERRED EMBODIMENT

Figure 1:
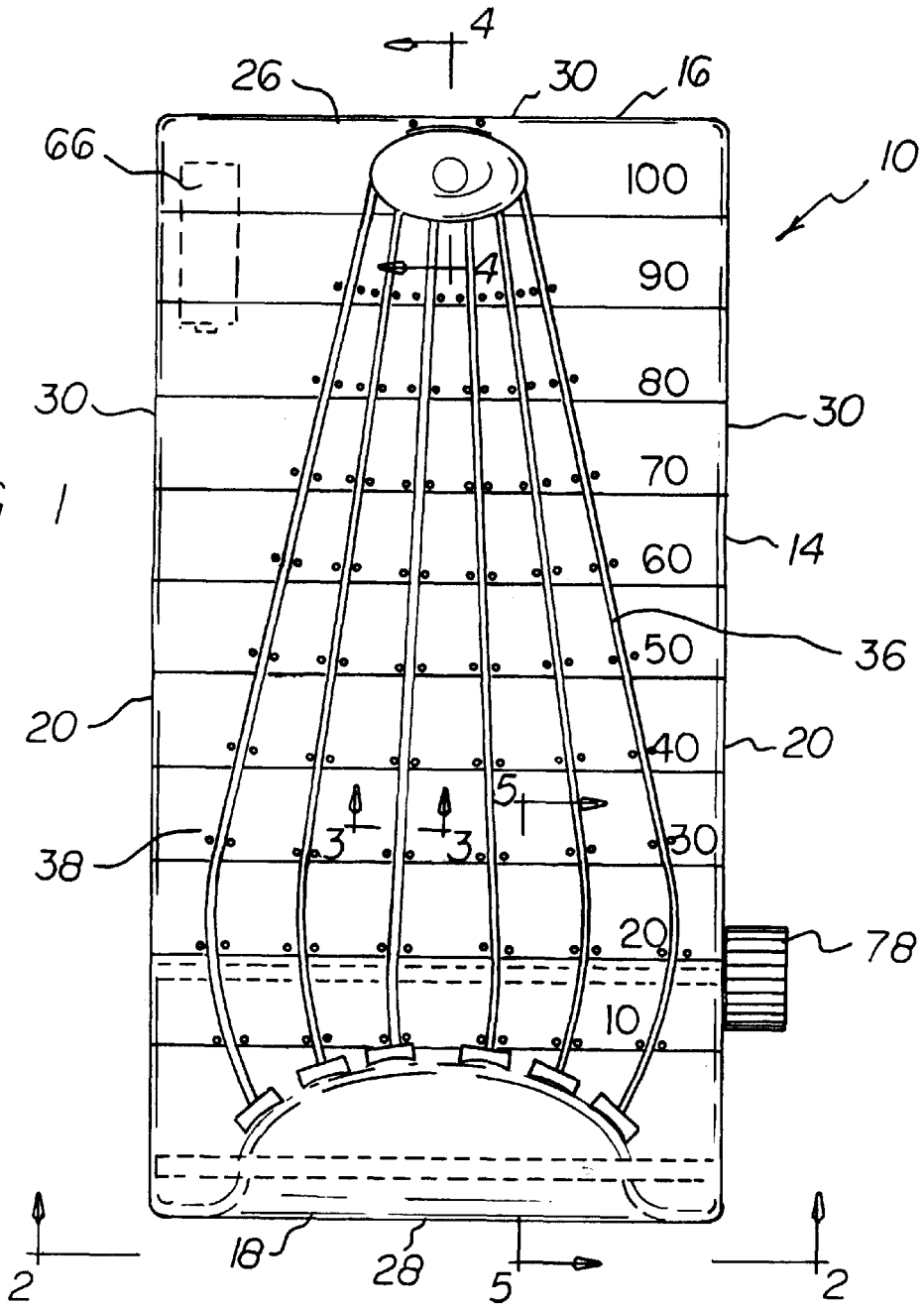
FIG. 1 is front elevational view of the new and improved hand exercise system constructed in accordance with the principles of the present invention.
Figure 2:
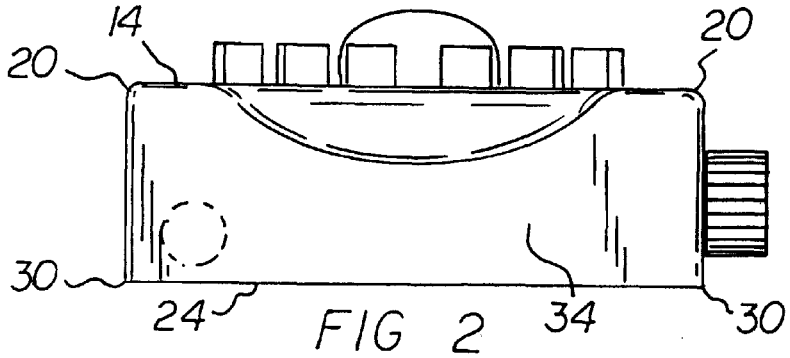
FIG. 2 is an end elevational view of the device taken at line 2—2 of FIG. 1.

With reference now to the drawings, and in particular to FIG. 1 thereof, the preferred embodiment of the new and improved hand exercise system embodying the principles and concepts of the present invention and generally designated by the reference numeral 10 will be described.

The present invention, the hand exercise system 10 is comprised of a plurality of components. Such components in their broadest context include an upper planar plate, a lower plate, a sidewall, five slots formed in the upper plate, a slide member, primary electrical contacts, and a plurality of apertures formed in the upper plate. Such components are individually configured and correlated with respect to each other so as to attain the desired objective.

First provided is an upper planar plate 14. The upper planar plate has a planar upper surface with an upper edge 16 and a parallel lower edge 18. The upper planar plate also has parallel side edges 20 there between.

A lower plate 24 is next provided. The lower plate has a planar lower surface with an upper edge 26 and a parallel lower edge 28. Parallel side edges 30 are provided between the upper edge and parallel lower edge.

Next provided is a sidewall 34. The sidewall couples the upper and lower plates to thereby retain them in a spaced parallel relationship. It also forms a housing with a chamber there within.

Five slots 36 are formed in the upper plate extending from adjacent the lower edge to adjacent the upper edge. The slots are spaced closer together at the upper edge than at the lower edge. The slots are even more widely spaced at an intermediate extent 38 proximate to the lower edge. Each slot has an upper slot portion 40. The upper slot portion extends downwardly from the upper surface of the upper plate to an intermediate extent 42 of the slot. An enlarged track 44 is formed within the upper plate. A lower slot portion 46 is formed beneath the upper plate.

A slide member 48 is slidably received within each slot. Each slide member is fabricated of an electrically conductive material. Each slide member has an intermediate enlarged section 50 within the track of the slot. Each slide member also has a downwardly extending connector. Each slide member also has an upwardly extending electrically conductive T-shaped member 52. An electrically insulated component 54 is secured above the T-shaped member for receiving a finger of a user.

Primary electrical contacts 58 are located on the upper surface, along the length of and on opposite sides of the slots. The primary electrical contacts are adapted to be contacted by the slide member periodically as the slide member moves along the slot to thereby close a circuit.

A plurality of apertures 62 are provided. The apertures are shaped as numbers. The apertures are formed in the upper plate laterally spaced from the primary electrical contacts. A light bulb 64 is provided beneath each aperture. A battery 66 and electrical connectors 68 are provided. The battery and electrical connectors couple each light bulb to the primary electrical contacts for the illumination of the light bulb when the slide member contacts the various associated electrical contacts.

A transparent dome 70 is formed on the upper surface adjacent the upper edge of the upper planar plate. An illuminator 72 is provided within the transparent dome. Electrical connectors 74 extend downwardly from the transparent dome are adapted to illuminate the illuminator when any slide member contacts the uppermost electrical contacts 76 proximate to the upper edge.

A rotatable cylindrical post 78 is provided within the housing and journaled in the sidewall adjacent to the lower edge. Such post, when rotated by a user, may increase or decrease the tension needed to push the slide members.

A plurality of resilient elastic bands 80 are next provided. Each band has a first end 82 coupled to a corresponding connector of a slide member. Each band has a second end 84 coupled to the post for lengthening or shortening the normal distance between the posts and each slide member. An associated tightening component 86 extends through a sidewall for rotation by a user to effectively lengthen or shorten the effective length of the elastic bands. The tightening component includes a knob 88 with an elastomeric washer 90 between the knob and the sidewall. The tightening component also includes a screw 92 coupling the knob and the cylindrical post. The tightening component further includes coupling axial slots 94 and associated axial projections 96 between the knob and cylindrical member to allow mutual rotation the slots and projections are coupled. This is for locking and unlocking purposes to thereby vary the force needed to effect the movement of the slide members within the slots. FIG. 6 shows a locked orientation. Loosening the screw would relieve the tension in the washer whereby the knob and post couple rotated to a desired tension. Thereafter the screw would be tightened to compress the washer and lock the system.

Figure 7:
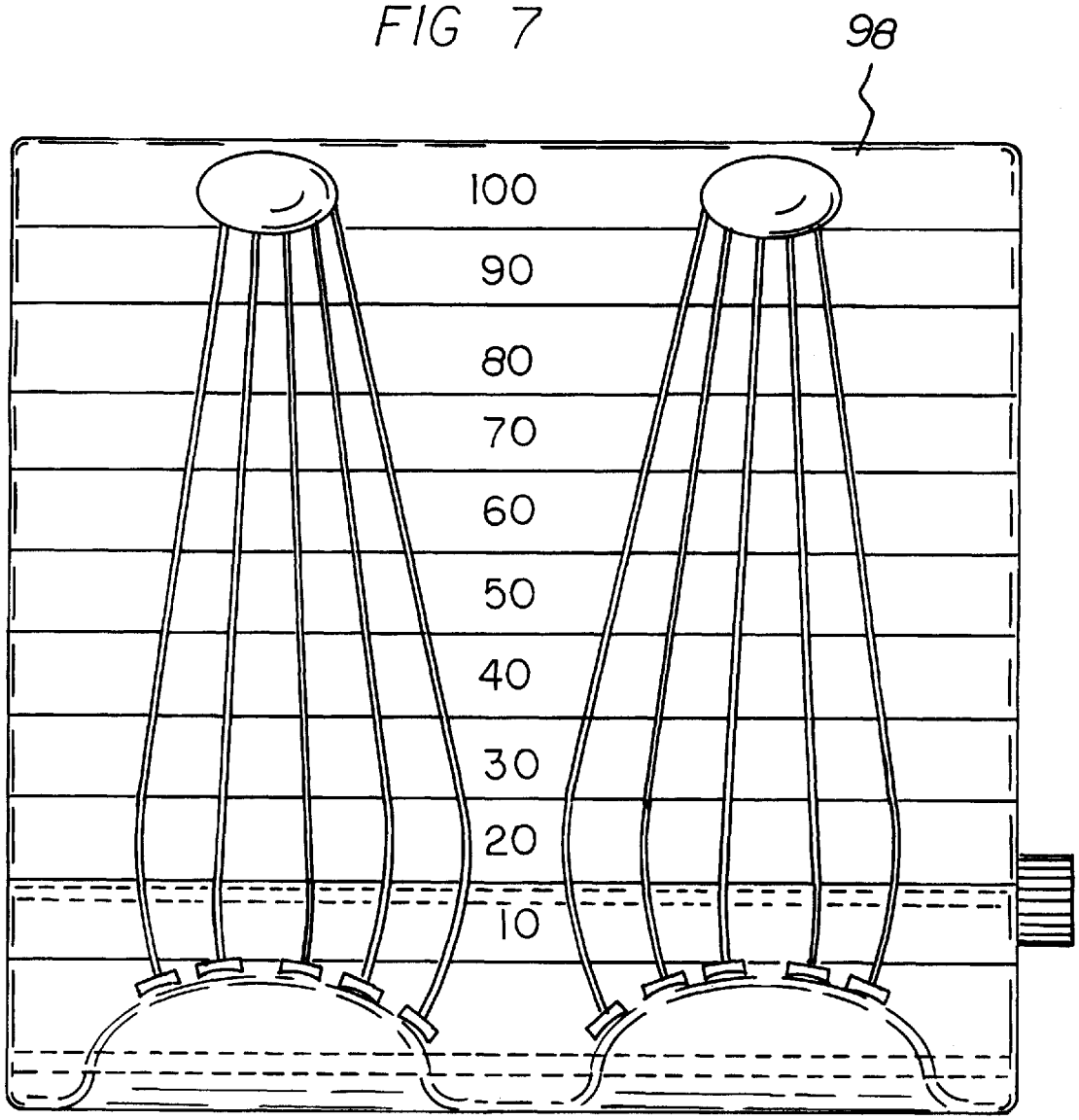
FIG. 7 is a front elevational view of an alternate embodiment of the invention similar to that of FIGS. 1–6 but enlarged and adapted to accommodate the two hands of a single user.

An alternate embodiment of the invention is shown in FIG. 7. In such embodiment, the system 98 is similar to that as shown in the prior Figures. Compare FIGS. 1 and 7. All of the various components of FIG. 1, as well as FIGS. 2 through 6, are employed in FIG. 7, except that the five slots of FIG. 1 are duplicated in a side by side relationship to form ten slots to provide for a system capable of strengthening and testing all fingers of both hands of a user simultaneously.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hand exercise system for strengthening and testing the individual fingers of the hands of users comprising, in combination:

an upper planar plate having a planar upper surface with an upper edge and a parallel lower edge, and having parallel side edges there between;

a lower plate having a planar lower surface with an upper edge and a parallel lower edge, and having parallel side edges there between;

a sidewall coupling the upper and lower plates to retain them in a spaced parallel relationship forming a housing with a chamber there within;

five slots formed in the upper plate extending from adjacent the lower edge to adjacent the upper edge, the slots being spaced closer together at the upper edge than at the lower edge with the slots even more widely spaced at an intermediate extent proximate to the lower edge, each slot having an upper slog portion extending downwardly from the upper surface of the upper plate to an intermediate extent thereof with an enlarged track formed within the upper plate and with a lower slot portion there beneath;

a slide member slidably received within each slot, each slide member being fabricated of an electrically conductive material having an intermediate enlarged section within the track of the slot and a downwardly extending connector and an upwardly extending electrically conductive T-shaped member with an electrically insulated component secured there above for receiving a finger of a user;

primary electrical contacts located on the upper surface and spaced along the length of the slots on opposite sides thereof adapted to be contacted by the slide member periodically as the slide member moves along the slot;

a plurality of apertures shaped as numbers formed in the upper plate laterally spaced from the primary electrical contacts with a light bulb beneath each aperture and with a battery and electrical connectors coupling each light bulb to the primary electrical contacts for the illumination thereof when the slide member contacts the various associated electrical contacts;

a transparent dome formed on the upper surface adjacent the upper edge with an illuminator therein and electrical connectors extending downwardly therefrom adapted to illuminate the illuminator when any slide member contacts the uppermost electrical contacts proximate to the upper edge;

a rotatable cylindrical post within the housing journaled in the sidewall adjacent to the lower edge;

a plurality of resilient elastic bands, each having a first end coupled to a corresponding connector of a slide member and having a second end coupled to the post for lengthening or shortening the normal distance between the posts and each slide member and with an associated tightening component extending through a sidewall for rotation by a user to effectively lengthen or shorten the effective length of the elastic bands, the tightening component including a knob with an elastomeric washer between the knob and the sidewall and a screw coupling the knob and the cylindrical post and axial coupling slots and associated axially coupling projections between the knob and cylindrical member to allow mutual rotation for locking and unlocking purposes to thereby vary the force needed to effect the movement of the slide members within the slots.

2. An exercise system comprising an upper planar plate, a lower plate, a sidewall coupling the upper and lower plates to retain them in a spaced parallel relationship forming a housing with a chamber there within, five slots formed in the upper plate extending from adjacent the lower edge to adjacent the upper edge, a slide member slidably received within each slot, each slide member being fabricated of an electrically conductive material with an electrically insulated component secured there above for receiving a finger of a user, primary electrical contacts located on the upper surface and spaced along the length of the slots on opposite sides thereof adapted to be contacted by the slide member periodically as the slide member moves along the slot, and a plurality of apertures shaped as numbers formed in the upper plate laterally spaced from the primary electrical contacts with a light bulb beneath each aperture and with a battery and electrical connectors coupling each light bulb to the primary electrical contacts for the illumination thereof when the slide member contacts the various associated electrical contacts.

3. The system as set forth in claim 2 and further including a transparent dome formed on the upper surface adjacent the upper edge with an illuminator therein and electrical connectors extending downwardly therefrom adapted to illuminate the illuminator when any slide member contacts the uppermost electrical contacts proximate to the upper edge.

4. The system as set forth in claim 3 and further including a rotatable cylindrical post within the housing journaled in the sidewall adjacent to the lower edge, a plurality of resilient elastic bands, each having a first end coupled to a corresponding connector of a slide member and having a second end coupled to the post for lengthening or shortening the normal distance between the posts and each slide member and with an associated tightening component extending through a sidewall for rotation by a user to effectively lengthen or shorten the effective length of the elastic bands, the tightening component including a knob with an elastomeric washer between the knob and the sidewall and a screw coupling the knob and the cylindrical post and axial coupling slots and associated axially coupling projections between the knob and cylindrical member to allow mutual rotation for locking and unlocking purposes to thereby vary the force needed to effect the movement of the slide members within the slots.

5. The system as set forth in claim 2 and further including a pair of side by side arrangement of slots for accommodating two hands of a user simultaneously.

* * * * *